United States Patent [19]

Hamilton, Sr.

[11] 4,184,603

[45] Jan. 22, 1980

[54] NON-SPILLING LIQUID CONTAINER

[76] Inventor: Calvin G. Hamilton, Sr., 1320 W. Cochise Dr., Apt. 1, Phoenix, Ariz. 85021

[21] Appl. No.: 958,002

[22] Filed: Nov. 6, 1978

Related U.S. Application Data

[63] Continuation-in-part of Ser. No. 887,496, Mar. 17, 1978, abandoned.

[51] Int. Cl.[2] ..... A47G 19/22

[52] U.S. Cl. ..... 220/254; 220/90.4; 220/366; 222/517; 222/518; 222/571

[58] Field of Search ..... 220/254, 264, 90.2, 220/90.4, 208, 366, DIG. 5; 222/515, 517, 518, 478, 482, 571

[56] References Cited

U.S. PATENT DOCUMENTS

| | | | |
|---|---|---|---|
| 1,457,070 | 5/1923 | Mayberry | 220/254 |
| 2,126,390 | 8/1938 | Jackson | 215/31 |
| 2,414,697 | 1/1947 | Pettersson | 220/90.4 |
| 2,478,544 | 8/1949 | Olson | 215/31 |
| 2,798,718 | 7/1957 | Gross | 267/161 |
| 3,015,404 | 1/1962 | Wayckens | 215/31 |
| 3,015,411 | 1/1962 | Smith | 220/90.4 |
| 3,208,629 | 9/1965 | Beeson | 220/90.4 |
| 3,338,467 | 8/1967 | Albert | 220/90.4 |
| 3,341,062 | 9/1967 | Phillips | 220/90.4 |
| 3,437,232 | 4/1969 | Goodwin, Jr. | 220/93 |
| 3,504,849 | 4/1970 | Quinn | 267/161 |
| 3,727,808 | 4/1973 | Fitzgerald | 222/482 |
| 3,749,274 | 7/1973 | Mele et al. | 220/234 |
| 3,797,696 | 3/1974 | Dibrell et al. | 220/90.4 |
| 3,952,910 | 4/1976 | Wheeler | 220/90.4 |
| 3,964,631 | 6/1976 | Albert | 222/518 |

*Primary Examiner*—Allan N. Shoap

*Attorney, Agent, or Firm*—Cahill, Sutton & Thomas

[57] ABSTRACT

A hollow container having an open top is provided with a cap releasably secured thereto. The cap, in turn, includes an open top having an inwardly and downwardly extending lip surrounding the opening. A lid is positioned in the opening and includes a peripheral lip that extends upwardly and outwardly to engage the lip of the cap to form a liquid seal therebetween. A spring member is seated within an annular groove within the cap and contacts the lid to urge the lid upwardly toward the cap. A slight air gap is maintained between the lips; the force of liquid in the container pushing against the lid when the container is tilted causes the lips to engage and maintain a liquid seal therebetween.

8 Claims, 5 Drawing Figures

NON-SPILLING LIQUID CONTAINER

This application is a continuation-in-part application of an application entitled "NON-SPILLING LIQUID CONTAINER", filed Mar. 17, 1978, assigned Ser. No. 887,496, now abandoned, and describing an invention made by the present inventor.

The present invention pertains to liquid containers, and more particularly, to a non-spilling liquid container of the type to be used for beverages.

Under certain circumstances, conventional cups or drinking glasses do not satisfactorily retain a liquid therein in a manner to prevent spilling. In circumstances where the consumer of the beverage is riding in a vehicle or even moving about such as commonly occurs in outdoor and sporting activities and events, it is difficult to prevent the beverage from accidentally spilling from the jarred or tipped container. When the container contains a hot beverage, injury may even ensue; further, if the beverage consumer is in a motor vehicle, a spilled hot beverage can result in significant inattention to the control of the vehicle thus possibly contributing to a vehicular accident.

Prior art containers have been suggested incorporating the top threadedly engaged with a container body. The top frequently incorporates a hole which is covered by a spring loaded valve. The liquid contents of the container are permitted to escape through the hole by depressing a handle or a trigger to collapse the spring and open the valve. Such prior art devices require a certain amount of manual dexterity in that the handle or trigger must be operated only at a precise time during the drinking operation.

Some prior art designs incorporate the use of a lid that was closed as a result of fluid pressure acting on the lower portion of the lid when the container was tipped. For example, the patent to Phillips, U.S. Pat. No. 3,341,062, describes a non-spilling drinking cup incorporating a lid or valve plate which is flat and is free to move toward or away from a sealing flange. Such flat plates do not always provide adequate sealing; further, it is difficult to ensure that the sealing flange and flat plate are formed within sufficient tolerances to ensure that liquid does not seep or leak. Such structures require some means to maintain the valve plate in centered alignment while nevertheless permitting the plate freedom to move vertically toward and away from the sealing flange.

Other types of non-spilling liquid containers incorporate springs such as that shown in the patent to Smith, U.S. Pat. No. 3,015,411, which securely forces a lid or valve plate against a sealing rim.

It is therefore an object of the present invention to provide a non-spilling container for containing a consumable beverage, which container does not require the actuation of a handle or trigger by the user's hand to release the liquid contents therein.

It is another object of the present invention to provide a simple and inexpensive non-spilling container wherein the liquid contents may be allowed to escape by the pressure of the beverage consumer's lip along the top of the container cap and wherein sealing pressure is provided by the pressure of the liquid within the container.

It is still another object of the present invention to provide a non-spilling beverage container that can be manufactured from relatively few components to provide an economic but nevertheless rugged beverage container.

These and other objects of the present invention will become apparent to those skilled in the art as the description thereof proceeds.

Briefly, in accordance with the embodiment chosen for illustration, a hollow cylindrical container having a handle and an open top is provided with an external thread adjacent the top. A cap having an internal thread at one end thereof, threadedly engages the opened end of the cylindrical container and extends upwardly therefrom to terminate in an annularly disposed inwardly and downwardly extending lip. A disc-shaped lid is positioned in the open top of the cap and incorporates an annular upwardly and outwardly extending lip. The lip of the cap and the lip of the lid are positioned so that they may be forced into contact with each other to form a liquid seal therebetween.

A spring member is secured to the interior of the cap and contacts the bottom of the lid to support the latter and maintain respective lips of the lid and cap in close proximity with each other.

The present invention may more readily be described by reference to the following drawings in which.

Figure 1:
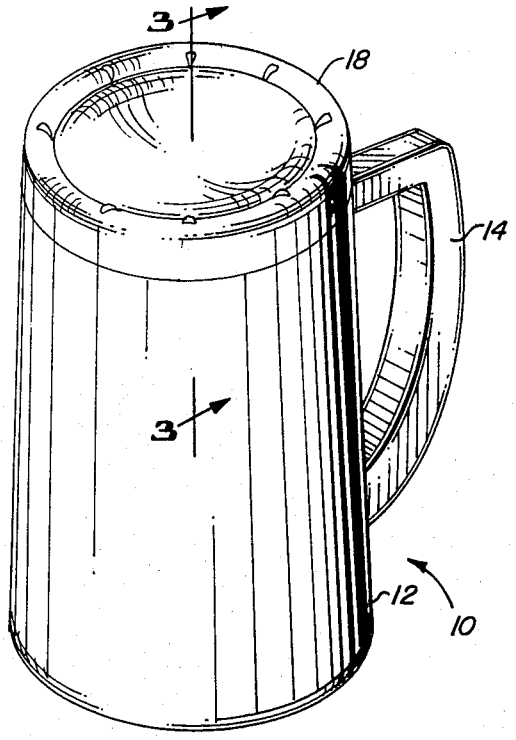
FIG. 1 is a perspective view of a non-spilling liquid container constructed in accordance with the teachings of the present invention.

Referring now to the drawings, a non-spilling liquid container 10 is shown incorporating a hollow cylindrical container body 12 having a conventional handle 14 extending therefrom. The top of the container body 15 is open to receive a liquid or beverage. The top of the container body also is provided with external threads 16 for threadedly engaging mating internal threads 17 of cylindrical cap 18.

The cap 18 extends upwardly from the container body 12 and is open at the upper end thereof. The upper end of the cap 18 terminates in an inwardly and downwardly extending lip 20. A plurality of small extensions or dams 22 are positioned about the opening formed in the top of the cap 18 and extend generally radially from an access 23 of the container body 12 and cap 18. The purpose of the dams 22 will be described hereinafter.

Figure 3:
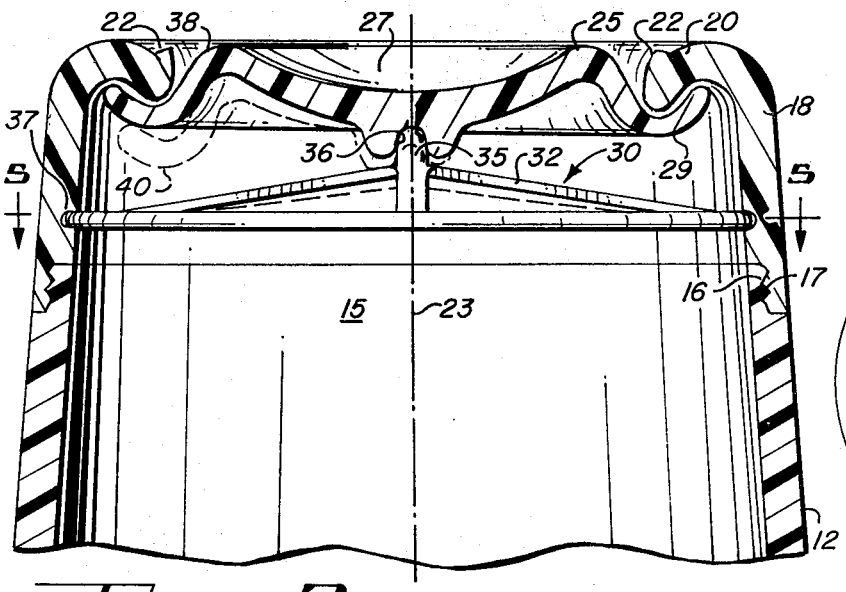
FIG. 3 is a cross-sectional view of the upper portion of the container of FIG. 1 taken along line 3—3.
Figure 5:
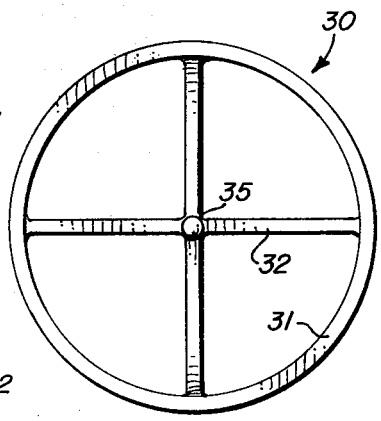
FIG. 5 is a cross-sectional view of FIG. 3 taken along line 5—5 showing a top view of the spring.

A lid 25 is positioned in the open top of the cap 18 and, in the embodiment chosen for illustration, is generally disc-shaped with a slight concavity at the center portion 27 thereof. The lid 25 includes an annularly disposed outwardly and upwardly extending lip 29 that contacts the lip 20 of the cap 18. The cap lip 20 and the lid lip 29 are formed to provide a liquid seal therebetween to prevent the contents of the container from escaping therethrough. A spring member 30 which may be formed of resilient plastic material which is thus easily cleaned, is positioned within the cap 18 as shown. The spring 30 includes an annular ring 31 and four radial arms 32 extending from a hub 33 to the ring. As shown in FIG. 3, the arms 32 extend out of the plane of the ring 31 and resiliently resist downward pressure on the hub 33. The top of the hub 33 is formed into an extension or pin 35 which engages a mating detent 36 provided in the lid 25. The ring 31 snaps into an annular channel 37 provided in the interior of the cap 18.

The lips 20 and 29 are positioned so that a slight gap is provided therebetween; it has been found that a gap of approximately 0.05 inches provides unexpected and unique advantages. A gap such as that described provides a means for gas to escape from the container and thus prevents the buildup of pressure from hot or carbonated beverages. When the container is tilted or turned on its side, the force of the liquid pushing against the bottom of the lid 25 is sufficient to cause the lips 20 and 29 to sealingly engage. Further, providing a gap between the lips 20 and 29 reduces the pressure necessary to open the lips 20 and 29 to permit the consumption of the beverage in the container. The lips of a consumer pushing against the outer portion 38 of the lid 25 are not required to exert as much force when the above mentioned gap is provided between the lips 20 and 29. Further, since the lip is inwardly and downwardly extending and the lip 29 is outwardly and upwardly extending, the mating surfaces of the lips provide a "wedging" action that effectively form a seal therebetween with only a very slight pressure acting on the lid. Therefore, only a very slight pressure exerted by the liquid contained in the container is necessary to cause an effective seal to prevent the escape of the liquid. Since the lid 25 is supported by a spring member 30, the gap between the lid and cap may be expanded beyond the slight gap; that is, the user's lip may not only force the lid to open the gap that was previously closed by the fluid pressure, but may also increase the distance between the lid and cap by exerting greater pressure against the spring member 30.

It may therefore be seen that the container body 12, the cap 18, the spring 30, and the lid 25, comprise only four components all of which may be conveniently molded of plastic materials for ruggedness, durability, and ease of cleaning. The spring 30 positions the lid 25 so that the lips 20 and 29 may be forced into sealing engagement by the pressure of any liquid acting upon the lid 25. It may be seen that even though the spring may be sufficiently strong to support the lid and maintain a slight gap between the lips 20 and 29, only relatively modest pressure need be applied along an outer portion 38 of the lid 25 to force the gap between the lips to become enlarged and permit a greater liquid flow from the container. This modest pressure is the result of the inherent leverage provided by the distance between the outer portion 38 and the detent 36. When the container is tilted or turned on its side, the force of the liquid pushing against the bottom of the lid 25 is sufficient to cause the lips 20 and 29 to sealingly engage.

Figure 2:
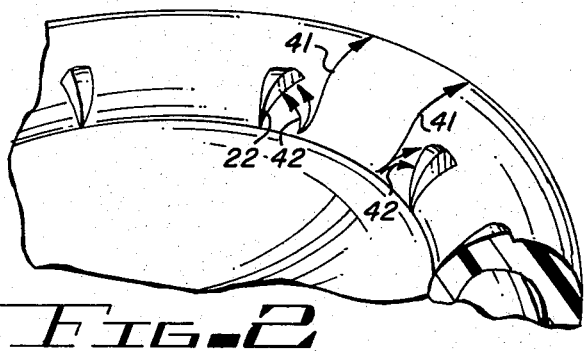
FIG. 2 is an enlarged view, partly in section, of a portion of the container of FIG. 1 showing the open top of the cap in greater detail.
Figure 4:
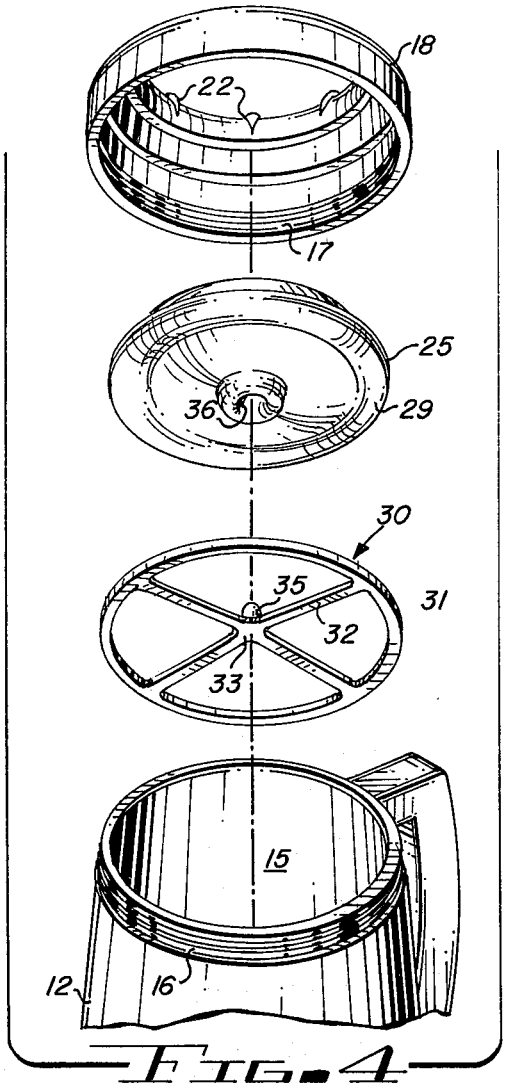
FIG. 4 is an exploded view of the top of the container of FIG. 1 showing the relationship of the cap, the lid, the spring, and the container body.

The non-spilling liquid container of the present invention may be used as follows. The cap 18 is unscrewed from the container body 12 and filled with the desired beverage. The cap is then replaced and the container will not permit the escape of the beverage regardless of the attitude or position in which the container is held. When it is desired to consume the beverage within the container, the container is lifted and placed to the lips of the consumer like a conventional cup or glass. A relatively slight pressure of the consumer's lip on the outer portion 38 of the lid 25 as the container is being tilted, as in drinking fashion, breaks the liquid seal between lips 20 and 29. The opening thus provided is maintained only so long as the pressure is maintained on the lid 25 by the consumer's lip. Because of the inherent leverage resulting from the positioning of the spring pressure at the center of the lid 25, the pressure required by the consumer is only slight. The lid 25, when in an open position, is shown in broken lines 40 in FIG. 3. As liquid flows from the opening thus provided, the liquid naturally has a tendency to flow annularly about the exterior of the lip 20. That is, in addition to the escaping liquid flowing as, for example, shown by the arrows 41 in FIG. 2, it will also have a tendency to flow annularly as suggested by the arrows 42. To inhibit this annular flow and avoid the possibility of dripping or spilling as the user consumes the beverage, the dams 22 provide a barrier which greatly inhibits the annular flow.

While the embodiment chosen for illustration has been described in terms of molded plastic materials because of the economies that can be achieved by such construction, it will be obvious to those skilled in the art that other materials may be used. For example, the molded plastic spring 30 could be replaced by a stainless steel spring having the same or even different configuration. Other modifications may also be made to the embodiment chosen for illustration; it may be noted that the handle 14 is molded integrally with the container body 12. It may be advantageous to form the cap 18 with the handle extending thereform, or to simply eliminate the handle and use the container as a glass or tumbler.

I claim:

1. A non-spilling liquid container for temporarily containing consumable liquids comprising:

a. a hollow container body having an opening for receiving and storing a liquid;

b. said hollow container including a cap having an open top and an inwardly and downwardly extending lip surrounding the open top;

c. a lid, positioned in the open top of said cap so as to be contacted by a consumer's lip when removing the liquid from said container, said lid including an annularly disposed, outwardly and upwardly extending lip; and d. spring means in contact with and supporting said lid with the lip on said lid opposed to and spaced from the lip on said cap to form a gap therebetween defining venting means, and forming a liquid seal therebetween when said liquid contacts said lid;

said cap, lid, and spring means in combination with said container defining anti-spilling drinking means whereby, consumable liquid in said container is prevented from escaping and whereby said liquid may be removed by a consumer by depressing said lid with his lip against the force of the liquid against said lid to break the liquid seal between the lip on said lid and the lip on said cap.

2. The combination set forth in claim 1 including a plurality of extensions positioned on the top of said cap adjacent the open top thereof forming dams to inhibit annular flow of liquid as it flows over the lip of said cap.

3. A non-spilling liquid container for temporarily storing consumable liquids comprising:

a. a hollow container body, having an open top, for receiving and storing a liquid;

b. a cap releasably secured over the open top of said container, said cap including an open top and an inwardly and downwardly extending lip surrounding the open top thereof;

c. a lid, positioned in the open top of said cap so as to be contacted by a consumer's lip when removing the liquid from said container, said lid including an annularly disposed outwardly and upwardly extending lip; and d. spring means in contact with and supporting said lid with the lip on said lid opposed to and spaced from the lip on said cap to form a gap therebetween defining venting means, and forming a liquid seal therebetween when said liquid contacts said lid;

said cap, lid, and spring means in combination with said container defining anti-spilling drinking means whereby, consumable liquid in said container is prevented from escaping and whereby said liquid may be removed by a consumer by depressing said lid with his lip against the force of the liquid against said lid to break the liquid seal between the lip on said lid and the lip on said cap.

4. The combination set forth in claim 3 wherein said container is cylindrical and wherein said cap is threadedly secured to the top of said cylindrical container.

5. The combination set forth in claim 4 wherein said spring means is mounted in said cap and includes a pin for engaging a detent provided in said lid.

6. The combination set forth in claim 3 including a plurality of extensions positioned on the top of said cap adjacent the open top thereof forming dams to inhibit annular flow of liquid as it flows over the lip of said cap.

7. The combination set forth in claim 5 wherein said spring means comprises an annular ring having a plurality of radial arms extending from a hub to said ring and wherein said pin extends upwardly from said hub into engagement with said detent.

8. The combination set forth in claim 7 wherein said spring means is secured to said cap by the engagement of said ring in an annular channel provided in said cap to receive said ring.

* * * * *